United States Patent [19]

Steigerwald

[11] 4,390,769

[45] Jun. 28, 1983

[54] INDUCTION HEATING APPARATUS PROVIDING SMOOTH POWER CONTROL

[75] Inventor: Robert L. Steigerwald, Scotia, N.Y.

[73] Assignee: General Electric Company, Schenectady, N.Y.

[21] Appl. No.: 154,222

[22] Filed: May 29, 1980

[51] Int. Cl.[3] ..... H05B 5/04

[52] U.S. Cl. ..... 219/10.77; 363/97; 363/98; 363/132; 323/350

[58] Field of Search ..... 219/10.77, 10.49, 492; 363/19, 17, 97, 98, 132; 323/1, 24, 122, 350; 307/96, 97, 363, 247 R

[56] References Cited

U.S. PATENT DOCUMENTS

| | | | |
|---|---|---|---|
| 3,466,528 | 9/1969 | Adams | 321/45 |
| 3,898,410 | 8/1975 | Peters, Jr. | 219/10.77 |
| 4,085,300 | 4/1978 | MacKenzie et al. | 219/10.49 R |
| 4,115,676 | 9/1978 | Higuchi et al. | 219/10.49 R |
| 4,201,957 | 5/1980 | Cathell | 363/17 |
| 4,211,912 | 7/1980 | Kiuchi et al. | 219/10.49 R |
| 4,241,250 | 12/1980 | Steigerwald | 219/10.49 R |

OTHER PUBLICATIONS

"Principles of Inverter Circuits" by B. D. Bedford & R. G. Hoft, John Wiley & Sons, 1964, pp. 235–238.

*Primary Examiner*—M. H. Paschall

*Attorney, Agent, or Firm*—William H. Steinberg; James C. Davis, Jr.; Marvin Snyder

[57] ABSTRACT

An improved induction heating apparatus comprises a full bridge inverter with each inverter leg fabricated of first and second serially coupled field effect transistors. A control apparatus coupled to the gate of each field effect transistor of each leg alternately renders the first and second field effect transistors of each inverter leg conductive. By varying the phase delay between initiation of alternate conduction of the field effect transistors of one inverter leg and subsequent initiation of alternate conduction of the field effect transistors of the other inverter legs in response to operator commands, smooth induction heating apparatus power control is achieved.

8 Claims, 2 Drawing Figures

10
FROM GATE DRIVE CIRCUIT 82
FROM GATE DRIVE CIRCUIT 44
INVERTER 12
POWER SUPPLY 16
EMI FILTER 22
GATE DRIVE CIRCUIT 48
GATE DRIVE CIRCUIT 82
LOGIC CIRCUIT
OVERLAP CONTROL CIRCUIT
TOGGLE FLIP FLOP
ASTABLE MULTIVIBRATOR
MULTI-VIBRATOR 64
ADJUSTABLE DELAY MULTIVIBRATOR CIRCUIT 62
CONTROL APPARATUS 34

INDUCTION HEATING APPARATUS PROVIDING SMOOTH POWER CONTROL

BACKGROUND OF THE INVENTION

This invention relates to induction heating, and more specifically to improved induction heating apparatus which provides smooth power control responsive to operator commands.

Induction heating, accomplished by eddy currents circulating in the surface of a metallic object with a time variant magnetic field to generate joule losses therein, has several advantages over heating by conventional techniques such as convection or conduction. In contrast to convection or conduction heating, induction heating is usually faster because of the lower thermal mass associated with induction heating systems. Also, because induction heating concentrates heat within the material of the object, as opposed to conduction or convection heating which concentrates heat on the object surface, higher energy transfer efficiency is obtained.

One of the major impediments to implementing induction heating on a widespread basis has been the inability to achieve smooth control of the power supplied by the inverter to the induction drive coil generating the time variant magnetic fields which circulate the eddy currents in the object surface. Inverters such as the type described and claimed in copending application Ser. No. 107,259, entitled "Parallel Resonant Induction Cooking Surface Unit," filed by Steigerwald et al., on Dec. 26, 1979 and assigned to the General Electric Co., have heretofore been controlled by varying the inverter duty cycle or the output frequency. While control of the inverter duty cycle or inverter output frequency permits control of inverter output power over a limited range, such control methods do not permit inverter output power to be smoothly regulated between zero and one hundred percent of maximum output power.

Accordingly, one object of the present invention is to provide induction heating apparatus which permits smooth control of inverter output power between zero and one hundred percent of maximum output power.

Another object of the present invention is to provide induction heating apparatus which may be fabricated of inexpensive components.

BRIEF SUMMARY OF THE INVENTION

Briefly, in accordance with a preferred embodiment of the invention, an improved induction heating apparatus capable of providing smooth variation of output power in accordance with operator commands comprises a full bridge inverter with each inverter leg configured of first and second switching devices serially coupled across a DC power supply. Coupled across the junctions between first and second switching devices of each inverter leg is a resonant induction drive coil load circuit configured of at least one induction drive coil which, when supplied with alternating current from the inverter, generates a time variant magnetic field for circulating eddy currents in the surface of a metallic object positioned adjacent to the resonant induction drive coil load circuit. A control apparatus coupled to the first and second switching devices of each inverter leg varies the phase delay between initiation of alternate conduction of the switching devices of one inverter leg and subsequent initiation of alternate conduction of the switching devices of the other inverter leg, in response to operator commands, so as to accomplish smooth variation of output inverter output power between zero and one hundred percent of maximum output power.

BRIEF SUMMARY OF THE INVENTION

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIG. 1 is a block diagram of the induction heating apparatus of the present invention; and FIG. 2 is an illustration of the output waveform generated by flip-flops which comprise a portion of the induction heating apparatus of FIG. 1.

DETAILED DESCRIPTION OF THE PREFERRED EMBODIMENT

Figure 1:
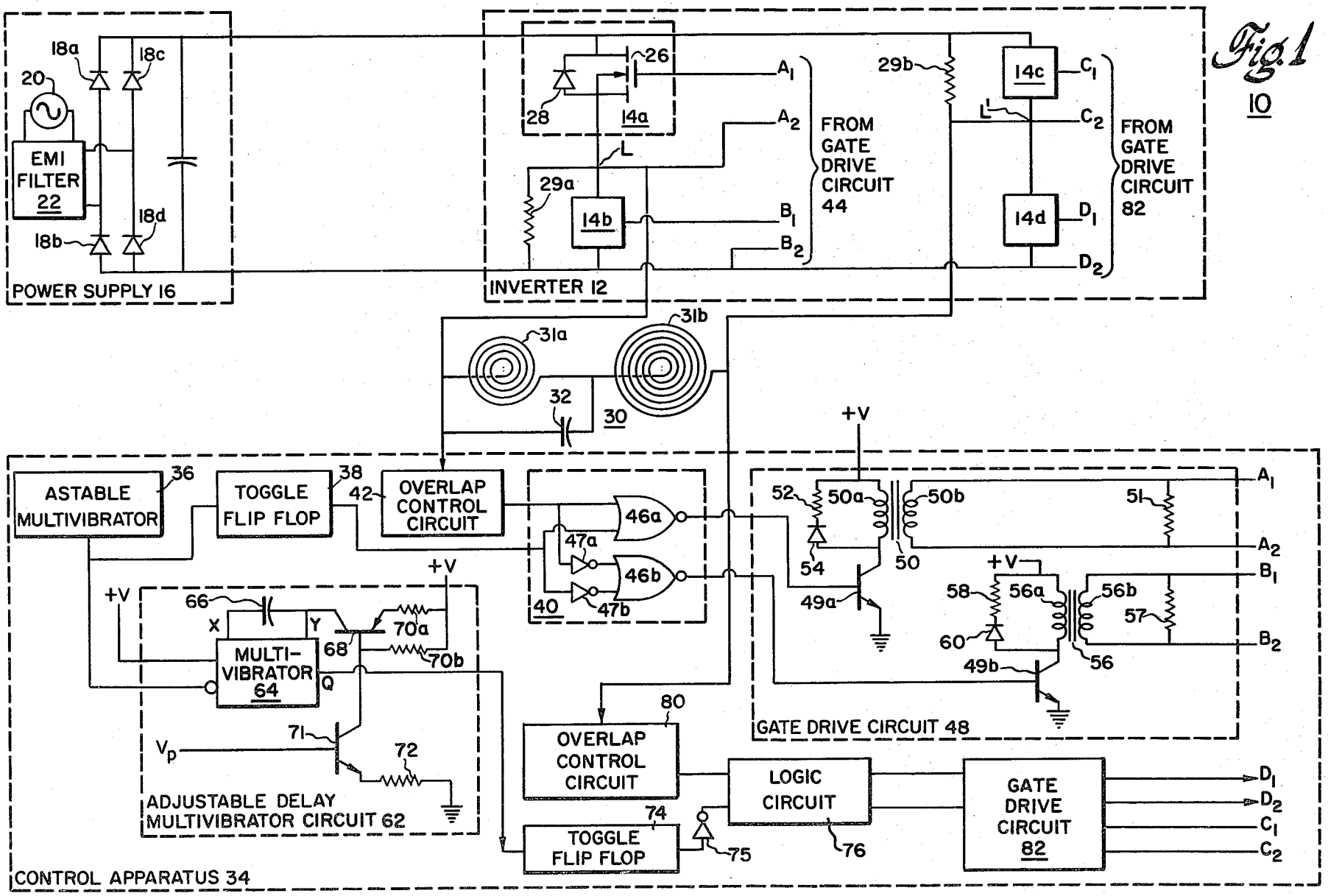

FIG. 1 illustrates an improved induction heating apparatus 10 comprised of a full bridge voltage inverter 12 such as is described and claimed in copending application Ser. No. 107,259 entitled "Parallel Resonant Induction Surface Cooking Unit" filed by Steigerwald et al., on Dec. 26, 1979 and assigned to General Electric Co. Inverter 12 comprises two pairs of serially coupled inverter switching devices **14*a* and 14*b*, and 14*c* and 14*d*, respectively, each pair of inverter switching devices forming one side or leg of the inverter. Each of switching device pairs 14*a* and 14*b*, and 14*c* and 14*d*, is coupled across the positive and negative terminals of a DC power supply 16. Power supply 16 typically comprises two pairs of diodes 18*a* and 18*b*, and 18*c* and 18*d*, respectively, the diodes of each pair coupled in series and the two pairs of diodes coupled in parallel. The cathodes of diodes 18*a* and 18*c* form the positive power supply terminal while the anodes of diodes 18*b* and 18*d* form the negative power supply terminal. An alternating current supply 20, typically a 50–60 Hz., 110 or 220 volt supply, is coupled in parallel with an electromagnetic interference filter 22 across the junction between diodes 18*a* and 18*b* and diodes 18*c* and 18*d*. A capacitor 24 is coupled across the pairs of diodes 18*a* and 18*b*, and 18*c* and 18*d*, to filter the DC voltage provided to inverter 12**.

Each of inverter switching devices **14*a* through 14*d*, such as switching device 14*a* for example, comprises a controlled solid state switching device capable of blocking high forward voltages until rendered conductive. In the presently preferred embodiment, each switching device such as, for example, 14*a* comprises a field effect transistor 26 and a diode 28 coupled in the reverse direction across the source-to-drain portion of field effect transistor 26**. By fabricating each of the switching devices of a field effect transistor, a less complex, and hence less expensive, circuit for rendering the switching device conductive is required.

Coupled across switching devices **14*b* and 14*c* is a resistance 29*a* and 29*b*, respectively, each typically having a value of 10,000 ohms. Resistances 29*a* and 29*b* assure that virtually no voltage appears across each of inverter switching devices 14*b* and 14*c*, respectively, when operation of induction heating apparatus 10** is initiated.

A resonant induction drive coil load circuit 30 is coupled between the junctions of inverter switching devices 14*a* and 14*b*, and 14*c* and 14*d*. In accordance with the teaching of the aforementioned copending application Ser. No. 107,259, load circuit 30 comprises first and second serially coupled induction drive coils 31*a* and 31*b*, respectively. Typically, each of induction drive coils 31*a* and 31*b* is configured of a "pancake" type coil with induction drive coil 31*a* being wound such that it is disposed within the area bounded by the circumference of induction drive coil 31*b*. A tuning capacitance 32 is coupled in parallel with induction drive coil 31*a* and is selected of a magnitude to tune load circuit 30 to resonate at a frequency at or near the inverter output frequency. By selecting tuning capacitance 32 of such value, reactive currents in inverter load circuit 30 are minimized, resulting in improved inverter load circuit power factor and nearly sinusoidal load current in the induction drive coils. Reducing inverter load circuit reactive currents also greatly reduces the reactive currents carried by each of switching devices 14*a*, 14*b*, 14*c*, and 14*d*, thereby reducing switching device stress.

A control apparatus 34 is coupled to each of switching devices 14*a*, 14*b*, 14*c*, and 14*d*, and supplies gate drive voltage to each switching device to render the switching devices of each inverter leg alternately conductive to supply alternating current to load circuit 30. Control apparatus 34 comprises an astable multivibrator 36 which supplies a clock signal twice every 40 microseconds to a T flip-flop or toggle flip-flop 38. Each time toggle flip-flop 38 is supplied with a clock signal from astable multivibrator 36, the toggle flip-flop output voltage amplitude alternately changes between a first level and a second level, thus appearing as a square wave. The output voltage of toggle flip-flop 38 is applied to the first input of a logic circuit 40. The second input to logic circuit 40 is coupled to the output of an overlap control circuit 42.

Overlap control circuit 42 is responsive to the voltage magnitude at the junction between switching devices 14*a* and 14*b*, designated as node L (as measured with respect to the negative terminal of power supply 16). Should neither of inverter switching devices 14*a* and 14*b* be rendered conductive, causing very little voltage to appear at node L, then overlap control circuit 42 supplies the second input of logic circuit 40 with a voltage at a first level. Conversely, should inverter switching device 14*a* become conductive, causing a large voltage to appear at node L, then overlap control circuit 42 supplies an output voltage at a second level to logic circuit 40. For further details regarding the structure and operation of overlap control circuit 42, reference should be had to the aforementioned copending application Ser. No. 107,259.

Logic circuit 40, when supplied with voltage at its first and second inputs from overlap control circuit 42 and toggle flip-flop 38, produces first and second output voltages, the amplitude of each voltage alternately changing from a first to a second level in accordance with a predetermined relationship between the voltages at the first and second logic circuit inputs. In the presently preferred embodiment, logic circuit 40 comprises a pair of NOR gates 46*a* and 46*b*, the first input of NOR gate 46*a* being coupled to the output of overlap control circuit 42 and the second input of NOR gate 46*a* and being coupled to toggle flip-flop 38. NOR gate 46*b* is coupled at its first input through a NOT gate 47*a* to the first input of NOR gate 46*a*. The second input of NOR gate 46*b* is coupled through NOT gate 47*b* to the second input of NOR gate 46*a*. NOR gates 46*a* and 46*b* of logic circuit 40 are each coupled at the output to a respective one of the first and second inputs of a gate drive circuit 48 which controls the conduction of each of inverter switching devices 14*a* and 14*b* in accordance with the logical level of the voltage at a separate one of its first and second inputs, respectively.

Gate drive circuit 48 comprises a pair of transistors 49*a* and 49*b*, transistor 49*a* being coupled at its base to the output of NOR gate 46*a* and transistor 49*b* being coupled at its base to the output of NOR gate 46*b*. The collector-to-emitter portion of transistor 49*a* is coupled in series with the primary winding 50*a* of the first transformer 50 between circuit ground and the positive terminal of a low voltage power supply (not shown). Terminals $A_1$ and $A_2$ of secondary winding 50*b* of transformer 50 are coupled to switching device 14*a*. Coupled across terminals $A_1$ and $A_2$ is a resistance 51 to limit switching device current. When transistor 49*a* is rendered conductive by NOR gate 46*a*, transformer 50 supplies gate drive voltage to inverter switching device 14*a* to render the same conductive. During intervals when transistor 49*a* is nonconductive, resistance 52 and diode 54, coupled in series across primary winding 50*a*, provide a completed path for gradually decreasing current conduction in transformer 50.

Transistor 49*b* is coupled with its collector-to-emitter portion in series with the primary winding 56*a* of a second transformer 56 between the positive low voltage power supply terminal and circuit ground. Terminals $B_1$ and $B_2$ of secondary winding 56*b* of transformer 56 are coupled to inverter switching device 14*b*. A resistance 57 is coupled across the secondary terminals $B_1$ and $B_2$ to limit inverter switching device current. During intervals when the output voltage amplitude of NOR gate 46*b* is at a first level, transistor 49*b* is rendered conductive, causing transformer 56 to supply inverter switching device 14*b* with gate drive voltage to render the same conductive. During intervals when transistor 49*b* is nonconductive, a resistance 58 and a diode 60, serially coupled across primary 56*a* of transformer 56, provide a completed path for gradually decreasing transformer 56 current.

In addition to supplying clock pulses to toggle flip-flop 38, astable multivibrator 36 supplies clock pulses to an adjustable delay multivibrator circuit 62. Adjustable delay multivibrator circuit 62 comprises a monostable multivibrator 64 coupled at its noninvert input to the positive low voltage power supply terminal and at its invert input to the output of astable multivibrator 36. A capacitance 66 is coupled across the timing port input terminals X and Y of multivibrator 64. Capacitance 66 is charged from the low voltage power supply through a transistor 68 coupled at its collector to timing input port terminal Y and at its emitter and base to the low voltage power supply positive terminal via a separate one of resistances 70*a* and 70*b*, respectively. A transistor 71 is coupled at its collector to the base of transistor 68. The emitter of transistor 71 is coupled to circuit ground through a resistance 72. By varying the voltage $V_p$ supplied between the base of transistor 71 and ground in accordance with operator commands, the current withdrawn from the base of transistor 68, and hence the collector current supplied from transistor 68 to capacitor 66, is varied accordingly. Varying the collector current of transistor 68 regulates capacitance 66 charge which, in turn, controls the phase delay between the astable multivibrator clock signal at the invert input of multivibrator 64 and the resultant Q output signal of multivibrator 64. As will become apparent hereinafter, varying the phase delay between the astable multivibrator clock signal and the Q output signal of multivibrator 64 regulates the phase delay between conduction initiation of one of inverter switching devices 14*a* and 14*b* and regulates the phase delay between subsequent conduction initiation of inverter switching devices 14*c* and 14*d*.

The output signal of adjustable delay multivibrator 62, i.e., the Q output signal of multivibrator 64, is supplied to the input of a toggle flip-flop 74 configured identically to toggle flip-flop 38. Each time toggle flip-flop 74 is supplied with a clock signal from adjustable multivibrator circuit 62, its output voltage alternately changes between a first and second amplitude, causing a square wave voltage to appear at the input of a NOT gate 75 which supplies a voltage, which is the inverse of toggle flip-flop 74 output voltage, to the second input of a logic circuit 76 configured identically to logic circuit 40. An overlap control circuit 80, configured identically to overlap control circuit 42, is coupled at its input to the junction, designated as node L', between inverter switching devices 14*c* and 14*d*. Overlap control circuit 80 is responsive to the presence of voltage at node L' (with respect to the negative terminal of power supply 16) and when inverter switching device 14*c* is rendered conductive, the output voltage supplied by overlap control circuit 80 to the first input of logic circuit 76 changes in amplitude from a first level to a second level. Logic circuit 76 is coupled at its first and second outputs to a separate one of the first and second inputs, respectively, of a gate drive circuit 82, configured identically to gate drive circuit 48. Gate drive circuit 82 is coupled at its first pair of output terminals $C_1$ and $C_2$ to inverter switching device 14*c* and at its second pair of output terminals $D_1$ and $D_2$ to inverter switching device 14*c*. In response to the amplitude of the voltage at each of its first and second inputs, gate drive circuit 82 renders inverter switching devices 14*d* and 14*c* alternately conductive.

Operation of inverter heating apparatus 10 will now be set forth by reference to FIGS. 1 and 2. Initially it will be assumed that none of inverter switching devices 14*a*–14*d* is conductive and thus the voltage at node L is "low", that is to say, at a magnitude less than half of the output voltage magnitude of power supply 16, while the voltage at node L' is "high," that is to say, at a magnitude greater than half of the output voltage magnitude of power supply 16. Upon receipt of the first clock signal from astable multivibrator 36, toggle flip-flop 38 generates an output voltage whose amplitude is at a first or logical "1" level. With the voltage at node L low, the output voltage amplitude of overlap control circuit 42 is at a first level. During the interval when the output voltages amplitude of each of overlap control circuit 42 and toggle flip-flop 38 are at their respective first levels, NOR gate 46*a* supplies transistor 49*a* of gate drive circuit 48 with base voltage whose amplitude is at a second or logical "0" level, causing the transistor, and hence inverter switching device 14*a*, to remain nonconductive. However, with the output voltage amplitude of each of overlap control circuit 42 and toggle flip-flop 38 now at first levels, NOR gate 46*b* supplies transistor 49*b* with base voltage whose amplitude is at a first level, causing the transistor to become conductive. Rendering transistor 49*b* conductive causes inverter switching device 14*b* to become conductive, due to the output voltage thereby produced on secondary winding 56*b* of transformer 56.

The clock signal produced by astable multivibrator 36 is also supplied to adjustable delay multivibrator circuit 62 which, after an interval proportional in duration to the voltage magnitude $V_p$, supplies toggle flip-flop 74 with a clock signal. In response to a clock signal from adjustable delay multivibrator circuit 62, toggle flip-flop 74 supplies an output voltage at a first level to NOT gate 75 which supplies the second input of logic gate 76 with voltage at a second level. With the voltage at node L' high, overlap control circuit 80 supplies the first input of logic circuit 76 with voltage at a second level. Logic circuit 76, when supplied at its first and second inputs with a first and second voltage, respectively, each at a second level, provides gate drive circuit 82 with first and second voltages each at a first and second level, respectively. As a result, gate drive circuit 82 renders inverter switching device 14*c* conductive. While inverter switching devices 14*b* and 14*c* are both conductive, a voltage $V_{L'L}$ of amplitude substantially equal to that of the power supply 16 output voltage appears across induction drive coil load circuit 30.

The second clock signal supplied by astable multivibrator 36 to flip-flop 38 is at a second level, causing the output voltage amplitude of NOR gate 46*b* to change to a second level. In response to the change in output voltage amplitude of NOR gate 46*b*, transistor 49*b* ceases conducting, thereby terminating winding 50*b* output voltage so as to render inverter switching device 14*b* nonconductive. Once inverter switching device 14*b* ceases conducting, decreasing induction drive coil load circuit current conduction is maintained by diode 28 of inverter switching device 14*a*. With diode 28 now conductive, the voltage at node L rises, and the output voltage amplitude of overlap control circuit 40 consequently changes to a second level. With the first and second input voltages of NOR gate 46*a* now both at a second level, the NOR gate supplies transistor 49*a* with base voltage at a first level, thereby rendering the transistor conductive and, in turn, rendering inverter switching device 14*a* conductive.

Upon receipt of the second clock signal from astable multivibrator 36, adjustable delay multivibrator 62 supplies toggle flip-flop 74 with another clock signal, but only after an interval proportional in duration to the voltage magnitude $V_p$. In response to the second clock signal, toggle flip-flop 74 supplies NOT gate 74 with a voltage whose amplitude is now at a second level, causing the NOT gate to supply the second input of logic circuit 76 with a voltage whose amplitude is now at a first level. Accordingly, logic circuit 76 provides gate drive circuit 82 with first and second voltages, each at a second level. Gate drive circuit 82 consequently renders inverter switching device 14*c* nonconductive. Once inverter switching device 14*c* ceases conducting, the diode of inverter switching device 14*d* maintains decreasing induction drive coil load circuit current conduction, causing the voltage at node L' to fall. The output voltage amplitude of overlap control circuit 80 thereupon changes from a second to a first level. With both of the input voltages to logic circuit 76 now at first levels, the logic circuit provides gate drive circuit 82 with a first and second input voltage at a first and second level, respectively, causing gate drive circuit 82 to render inverter switching device 14*d* conductive. During the interval when both inverter switching devices 14*a* and 14*d* are conductive, a voltage $-V_{L'L}$ of magnitude substantially equal to that of the power supply 16 output voltage is present across induction drive coil load circuit 30.

When astable multivibrator 36 produces the third clock signal, inverter switching device 14*a* is rendered nonconductive and inverter switching device 14*d* is then rendered conductive. Similarly, after an interval following generation of the third astable multivibrator clock signal, inverter switching device 14*b* is rendered nonconductive and inverter switching device 14*c* is the rendered conductive. The alternate conduction of inverter switching devices 14*b* and 14*c*, and 14*a* and 14*d*, is repeated continuously in the manner described above, resulting in production of alternating current voltage across inverter induction drive coil load circuit 30. When supplied with an alternating current voltage, drive coil load circuit 30 generates a time-variant magnetic field which circulates eddy current in the surface of a metallic object (not shown) positioned adjacent to drive coils 31*a* and 31*b*, causing joule losses in the object's surface, and hence object heating. By adjusting the period of the clock pulses produced by astable multivibrator 36, the frequency of inverter switching device conduction, and hence the inverter output frequency, can be adjusted accordingly.

Figure 2A:
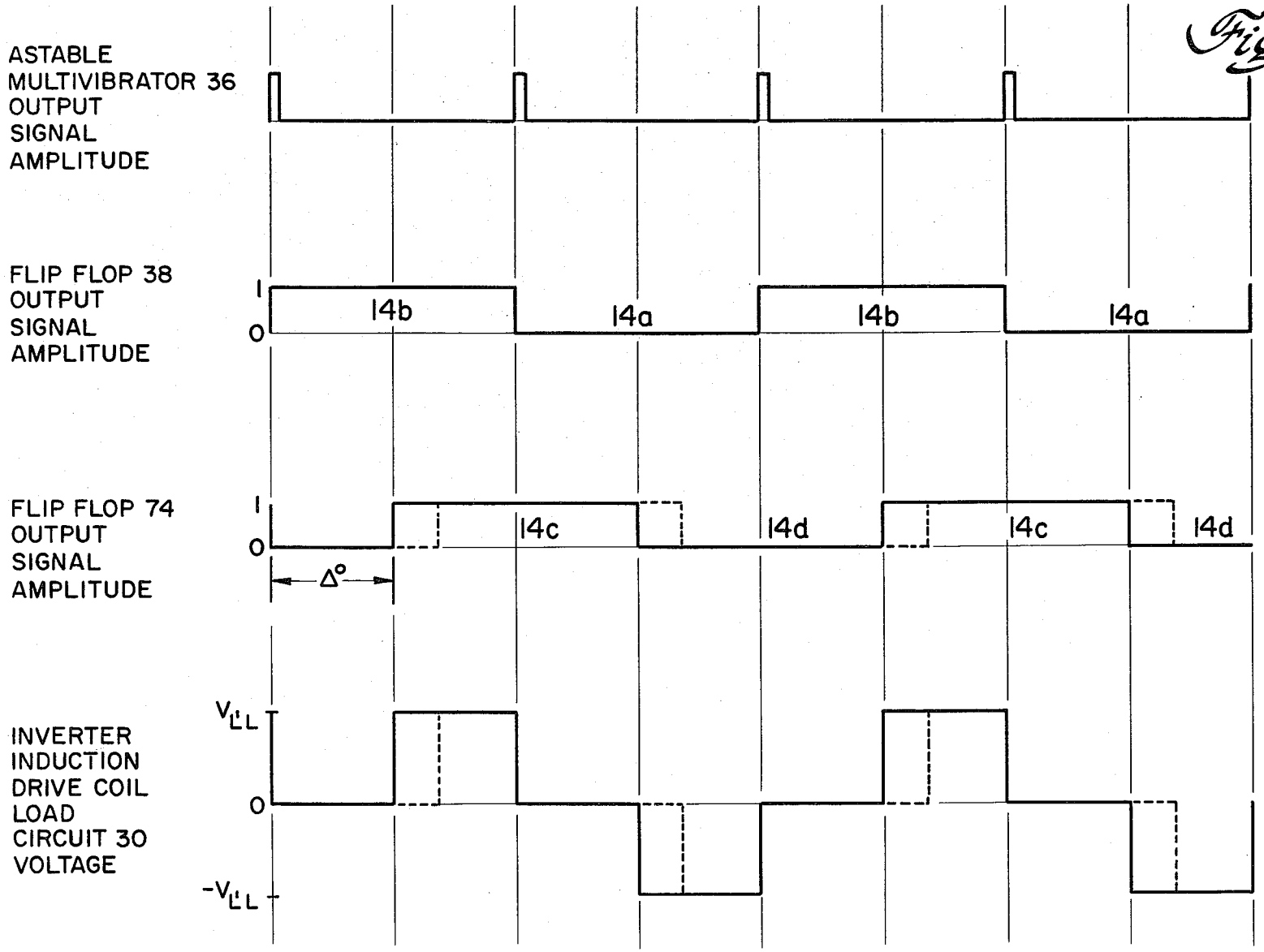

The above-described sequence of inverter switching device conduction may be more clearly understood by reference to FIG. 2. Whenever astable multivibrator 36 generates a clock signal, the output voltage amplitude of flip-flop 38 alternately changes between logical "1" and "0" levels. While the output voltage amplitude of flip-flop 38 is at a logical "1" level, inverter switching device 14*b* is conductive. Conversely, while flip-flop 38 output voltage amplitude is at a logical "0" level, inverter switching device 14*a* is conductive. The output voltage amplitude of flip-flop 74 also alternates between logical "1" and logical "0" levels in response to periodic clock signals from astable multivibrator 36, but only after an interval, indicated by the phase angle $\Delta$ following generation of a clock signal by astable multivibrator 36. During intervals when the output voltage amplitude of flip-flop 74 is at a logical "1" level, inverter switching device 14*c* is conductive while, during intervals that the flip-flop signal amplitude is at a "0" logical level, inverter switching device 14*d* is conductive. The alternate conduction of the inverter switching device pairs 14*b* and 14*c*, and 14*a* and 14*d*, results in an alternating current voltage $V_{L'L}$ of amplitude substantially equal to that of the power supply 16 output voltage across induction drive coil load circuit 30. By varying the phase angle $\Delta$, that is, by varying the phase delay between the start of alternate conduction of inverter switching devices 14*b* and 14*a* and the start of alternate conduction of inverter switching devices 14*c* and 14*d*, the magnitude of the inverter drive coil circuit load voltage can be varied accordingly. Since the magnitude of $\Delta$ is controlled by the magnitude of $V_p$, adjusting $V_p$ to increase $\Delta$ decreases the inverter drive coil load circuit voltage magnitude while decreasing $\Delta$ increases the inverter drive coil load circuit voltage magnitude. Inverter output power is proportional to the square of the inverter drive coil load circuit voltage, and thus by varying $V_p$, $\Delta$ can be varied between 180° and 0° to effect smooth variation of inverter output power between 0 and 100% of maximum inverter output power. It should be noted that despite the harmonics in inverter load circuit voltage 30 as illustrated in FIG. 2, inverter drive coil load circuit 30 current is nearly sinusoidal since, by tuning the inverter drive coil load circuit 30 to resonate at or near the inverter output frequency in the manner described in copending application Ser. No. 107,259, the harmonics are filtered out.

The foregoing describes an improved induction heating apparatus which allows smooth control of inverter output power between zero and one hundred percent of maximum output power, and which may be fabricated of inexpensive components.

While only certain preferred features of the invention have been shown by way of illustration, many modifications and changes will occur to those skilled in the art. It is, therefore, to be understood that the appended claims are intended to cover all such modifications and changes as fall within the true spirit of the invention.

What is claimed is:

1. An improved induction heating apparatus providing smooth power control comprising:

a direct current power supply;

a full bridge inverter having first and second legs, each inverter leg comprised of first and second gate turn-on switching means serially coupled across the output of said direct current power supply, each of said first and second gate turn-off switching means of each inverter leg comprising a field transistor and a diode coupled in the reverse power supply voltage direction across the drain-to-source portion of said field effect transistor;

a resonant induction drive coil load circuit coupled between the junctions of the switching means of said first and second inverter legs, respectively; and a control apparatus coupled to each of said switching means of said first and second inverter legs for rendering said first and second switching means of each said inverter leg conductive at alternate intervals, said control apparatus controllably delaying initiation of alternate conduction of the switching means of said second inverter leg after initiation of alternate conduction of the switching means of said first inverter leg in accordance with the magnitude of an operator-varied voltage, thereby permitting smooth variation of inverter output power between 0 to 100 percent of maximum output power, said control apparatus comprising an astable multivibrator clock means for generating an output signal at uniform periodic intervals, first circuit means having a first input coupled to the junction between switching means of said first inverter leg and having a second input coupled to said clock means, said first circuit means coupled at its first and second outputs to a separate one of said first and second switching means of said first inverter leg, respectively, and alternately rendering one of said first and second switching means of said first inverter leg conductive in response to said clock means output signal, said first circuit means comprising a toggle flip-flop having an input coupled to said clock means and producing an output voltage which alternately changes in amplitude between a first and second level in response to said clock means output clock signal, an overlap control circuit having an input coupled to the junction between switching devices of said first inverter leg and producing an output voltage which changes in amplitude from a first to a second level in response to the voltage at its input, a logic circuit coupled at its first input to said toggle flip-flop and coupled at its second input to said overlap control circuit, said logic circuit producing a first output voltage whose amplitude changes from a first to a second level in accordance with a first predetermined relationship between voltages at it first and second inputs and producing a second output voltage whose amplitude changes from a first to a second level in accordance with a second predetermined relationship between voltages at its first and second input and gate drive circuit means coupled at its first and second input to said logic circuit means and coupled at each of its first and second output to a separate one of said first and second switching means, respectively, of said first inverter leg, said gate drive circuit supply said first and second switching means with gate drive voltage in accordance with the amplitude of a separate one of said logic circuit first and second output voltages, respectively, delay circuit means having an input coupled to said clock means, said delay circuit means generating an output signal after an interval following receipt of said clock means output signal, said interval being variable in duration in accordance with said operator-varied voltage, and second circuit means having a first input coupled to the junction between switching means of said second inverter leg and having a second input coupled to said delay circuit means, said second circuit means coupled at its first and second outputs to a separate one of said first and second switching means of said second inverter leg, respectively, and alternately rendering one of said first and second switching means of said second inverter leg conductive in response to said delay circuit means output signal.

2. The invention according to claim 1 wherein said gate drive circuit means comprises:

a low voltage power supply;

a first transformer having a primary winding and secondary winding, said secondary winding coupled to said first switching means of said first inverter leg;

a first transistor having a base coupled to a first output of said logic circuit and having a collector and emitter, the collector-to-emitter portion of said first transistor coupled in series with said primary of said first transformer between said low voltage power supply and circuit ground, said first transistor, when rendered conductive, rendering said first switching means of said first inverter leg conductive;

means coupled across said primary of said first transformer for providing a completed path for decreasing transformer currents during intervals when said first transistor is nonconductive;

a second transformer having a primary winding and having a secondary winding coupled to said second switching means of said first inverter leg;

a second transistor having a base coupled to a second output of said logic circuit and having a collector and emitter, the collector-to-emitter portion of said second transistor coupled in series with said primary of said second transformer between said low voltage power supply and circuit ground, said second transistor, when rendered conductive, rendering said second switching means of said first inverter leg conductive; and means coupled across the primary of said second transformer for providing a completed path for decreasing transformer currents during intervals when said second transistor is nonconductive.

3. The invention according to claim 1 wherein said logic circuit comprises:

a first two input NOR gate having a first input coupled to said overlap control circuit, a second input coupled to said toggle flip-flop and having an output coupled to the first input of said gate drive circuit means;

a second two input NOR gate having first and second inputs and an output, said output coupled to said second input of said gate drive circuit means;

a first NOT gate coupled at its input to the output of said overlap control circuit and coupled at its output to the first input of said second NOR gate; and a second NOT gate coupled at its input to the output of said toggle flip-flop and coupled at its output to the second input of said second NOR gate.

4. An improved induction heating apparatus providing smooth power control comprising:

a direct current power supply;

a full bridge inverter having first and second legs, each inverter leg comprised of first and second gate turn-on switching means serially coupled across the output of said direct current power supply, each of said first and second gate turn-off switching means of each inverter leg comprises a field effect transistor and a diode coupled in the reverse power supply voltage direction across the drain-to-source portion of said field effect transistor;

a resonant induction drive coil load circuit coupled between the junctions of the switching means of said first and second inverter legs, respectively; and a control apparatus coupled to each of said switching means of said first and second inverter legs for rendering said first and second switching means of each said inverter leg conductive at alternate intervals, said control apparatus controllably delaying initiation of alternate conduction of the switching means of said second inverter leg after initiation of alternate conduction of the switching means of said first inverter leg in accordance with the magnitude of an operator-varied voltage, thereby permitting smooth variation of inverter output power between 0 to 100 percent of maximum output power, said control apparatus comprising an astable multivibrator clock means for generating an output signal at uniform periodic intervals, first circuit means having a first input coupled to the junction between switching means of said first inverter leg and having a second input coupled to said clock means, said first circuit means coupled at its first and second outputs to a separate one of said first and second switching means of said first inverter leg, respectively, and alternately rendering one of said first and second switching means of said first inverter leg conductive in response to said clock means output signal, delay circuit means having an input coupled to said clock means, said delay circuit means generating an output signal after an interval following receipt of said clock means output signal, said interval being variable in duration in accordance with said operator-varied voltage, said delay circuit means comprising a multivibrator circuit having an input coupled to said clock means, a pair of timing port inputs, and an output coupled to the second input of said second circuit means, said multivibrator producing an output signal after an interval following receipt of a clock signal from said clock means, said interval varying in duration in accordance with the voltage amplitude across said pair of timing port inputs, a capacitance coupled across said pair of timing port inputs of said multivibrator, and means coupled to said capacitance for varying the charge on said capacitance and thereby varying the voltage across said pair of timing port inputs of said multivibrator in accordance with said operator-varied voltage, and second circuit means having a first input coupled to the junction between switching means of said second inverter leg and having a second input coupled to said delay circuit means, said second circuit means coupled at its first and second outputs to a separate one of said first and second switching means of said second inverter leg, respectively, and alternately rendering one of said first and second switching means of said second inverter leg conductive in response to said delay circuit means output signal.

5. The invention according to claim 4 wherein said means to vary the charge on said capacitance comprises:

a low voltage power supply;

a first transistor having a base, collector and emitter, the collector-to-emitter portion of said first transistor being coupled between said capacitance and said low voltage power supply; and a second transistor having a base, collector and emitter, the collector-to-emitter portion of said second transistor being coupled between the base of said first transistor and circuit ground, said second transistor controlling the current carried by said first transistor and thereby controlling the charge on said capacitance in accordance with the magnitude of said operator-varied voltage.

6. An improved induction heating apparatus providing smooth power control comprising:

a direct current power supply;

a full bridge inverter having first and second legs, each inverter leg comprised of first and second gate turn-on switching means serially coupled across the output of said direct current power supply, each of said first and second gate turn-off switching means of each inverter leg comprising a field effect transistor, and a diode coupled in the reverse power supply voltage direction across the dtain-to-source portion of said field effect transistor;

a resonant induction drive coil load circuit coupled between the junctions of the switching means of said first and second inverter legs, respectively; and a control apparatus coupled to each of said switching means of said first and second inverter legs for rendering said first and second switching means of each said inverter leg conductive at alternate intervals, said control apparatus controllably delaying initiation of alternate conduction of the switching means of said second inverter leg after initiation of alternate conduction of the switching means of said first inverter leg in accordance with the magnitude of an operator-varied voltage, thereby permitting smooth variation of inverter output power between 0 to 100 percent of maximum output power, said control apparatus comprising an astable multivibrator clock means for generating an output signal at uniform periodic intervals, first circuit means having a first input coupled to the junction between switching means of said first inverter leg and having a second input coupled to said clock means, said first circuit means coupled at its first and second outputs to a separate one of said first and second switching means of said first inverter leg, respectively, and alternately rendering one of said first and second switching means of said first inverter leg conductive in response to said clock means output signal, delay circuit means having an input coupled to said clock means, said delay circuit means generating an output signal after an interval following receipt of said clock means output signal, said interval being variable in duration in accordance with said operator-varied voltage and second circuit means having a first input coupled to the junction between switching means of said second inverter leg and having a second input coupled to said delay circuit means, said second circuit means coupled at its first and second outputs to a separate one of said first and second switching means of said second inverter leg, respectively, and alternately rendering one of said first and second switching means of said second inverter leg conductive in response to said delay circuit means output signal, said second circuit means comprising toggle flip-flop means having an input coupled to said delay circuit means and producing an output voltage which alternately changes in amplitude between a first level and a second level in response to the output signal of said delay circuit means, an overlap control circuit having an input coupled to the junction between switching devices of said second inverter leg and producing an output voltage which changes in amplitude from a first to a second level in response to the amplitude of voltage at its input, a logic circuit coupled at its first input to said toggle flip-flop means and coupled at its second input to said overlap control circuit, said logic circuit producing a first output voltage whose amplitude changes from a first level to a second level in accordance with a first predetermined relationship between voltages at its first and second inputs and producing a second output voltage whose amplitude changes from a first level to a second level in accordance with a second predetermined relationship between voltages at its first and second inputs, and gate drive circuit means coupled at its first and second inputs to said logic circuit means and coupled at its first and second outputs to a separate one of said second and first switching means of said second inverter leg, respectively, for supplying gate drive voltage thereto.

7. The invention according to claim 6 wherein said gate drive circuit means comprises:

a low voltage power supply;

a first transformer having a primary winding and secondary winding, said secondary winding coupled to said first switching means of said second inverter leg;

a first transistor having a base coupled to a first output of said logic circuit and having a collector and emitter, the collector-to-emitter portion of said first transistor coupled in series with said primary of said first transformer between said low voltage power supply and circuit ground, said first transistor, when rendered conductive, rendering said first switching means of said second inverter leg conductive;

means coupled across said primary of said first transformer for providing a completed path for decreasing transformer currents during intervals when said first transistor is nonconductive;

a second transformer having a primary winding and having a secondary winding coupled to said second switching means of said second inverter leg;

a second transistor having a base coupled to a second output of said logic circuit and having a collector and emitter, the collector-to-emitter portion of said second transistor coupled in series with said primary of said second transformer between said low voltage power supply and circuit ground, said second transistor, when rendered conductive, rendering said second switching means of said second inverter leg conductive, and means coupled across the primary of said second transformer for providing a completed path for decreasing transformer currents during intervals when said second transistor is nonconductive.

8. The invention according to claim 6 wherein said logic current comprises:

a first two input NOR gate having its first input coupled to said overlap control circuit, its second input coupled to said toggle flip-flop and having an output coupled to the first input of said gate drive circuit means;

a second two input NOR gate having first and second inputs and an output, said output coupled to said second input of said gate drive circuit means;

a first NOT gate coupled at its input to the output of said overlap control circuit and coupled at its output to the first input of said second NOR gate; and a second NOT gate coupled at its input to the output of said toggle flip-flop and coupled at its output to the second input of said second NOR gate.

* * * * *